United States Patent [19]

Auer et al.

[11] Patent Number: 4,489,024

[45] Date of Patent: Dec. 18, 1984

[54] METHOD OF AND APPARATUS FOR THE MANUFACTURE OF PREFABRICATED PRESTRESSED CONCRETE MEMBERS

[75] Inventors: Peter Auer, Ottobrunn; Fritz Kluge, Munich-Grosshadern; Helmut Lieske; Host Wutzler, both of Munich, all of Fed. Rep. of Germany

[73] Assignee: Dyckerhoff & Widmann Aktiengesellschaft, Munich, Fed. Rep. of Germany

[21] Appl. No.: 285,043

[22] Filed: Jul. 20, 1981

[51] Int. Cl.[3] ..... B28B 3/04

[52] U.S. Cl. ..... 264/71; 264/228; 264/333

[58] Field of Search ..... 264/71, 333, 228

[56] References Cited

U.S. PATENT DOCUMENTS

| | | | |
|---|---|---|---|
| 4,105,382 | 8/1978 | Auer | 425/111 |
| 4,273,740 | 6/1981 | Marchesi | 264/228 |
| 4,290,991 | 9/1981 | Thim | 264/228 |

*Primary Examiner*—John Parrish

*Attorney, Agent, or Firm*—Toren, McGeady and Stanger

[57] ABSTRACT

Prefabricated prestressed concrete members are formed on a stressing bed with a number of working stations arranged next to one another along the length of the bed. A frame froms the working stations and the frame is movable over the stressing bed. With a previously poured concrete member in one of the working stations, part of a form is placed in another working station and is filled with concrete. After the form part is completely filled and consolidated, a second form part is placed downwardly on the filled part completing the form. A lifting member on the frame which placed the second form part on the filled part is then moved to the station containing the previously poured member which is still within the form. The form is stripped from the concrete member and the frame is then moved along with the lifting member returning the stripped form to the working station where it is to be filled with concrete. After the stripped form is moved the second form part is separated from the part to be filled with concrete and is moved into another working station where it is cleaned and readied for the next working cycle.

5 Claims, 8 Drawing Figures

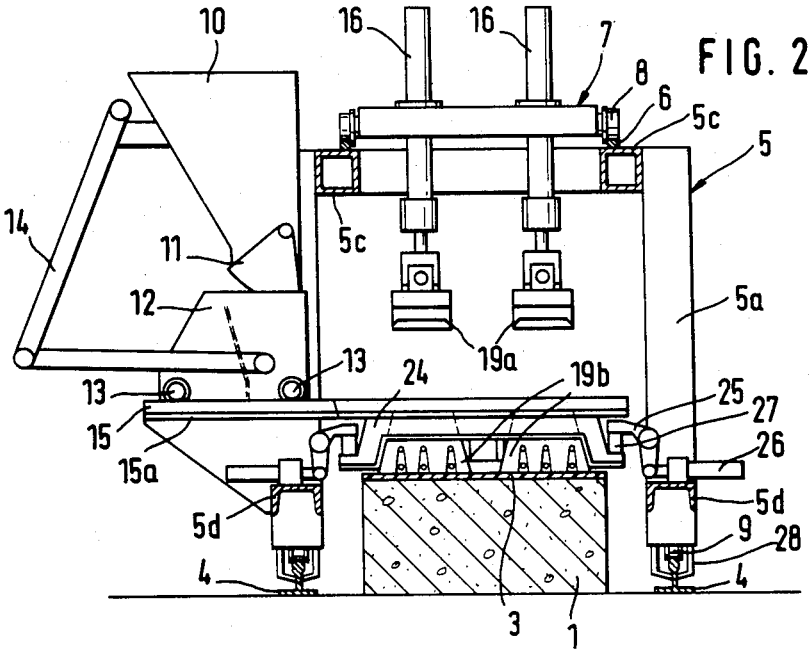
FIG. 2
FIG. 3a
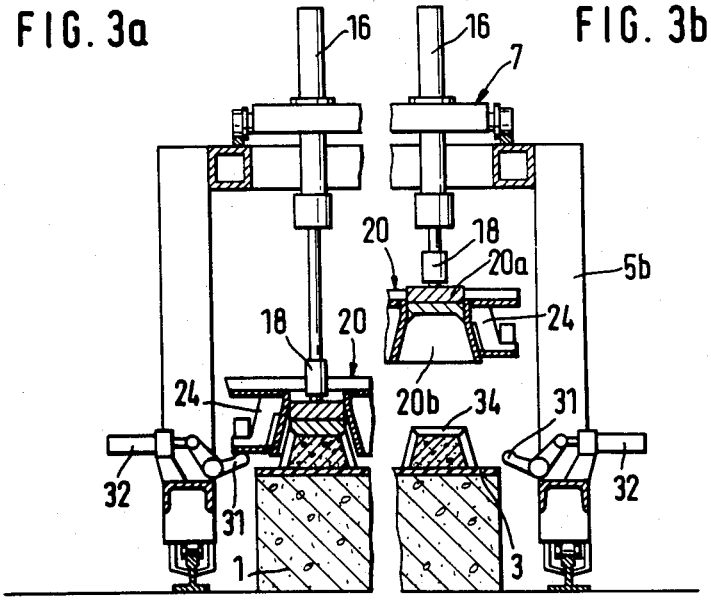
FIG. 3b

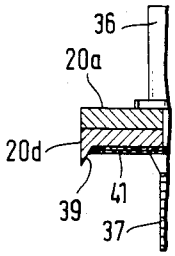
FIG. 4a
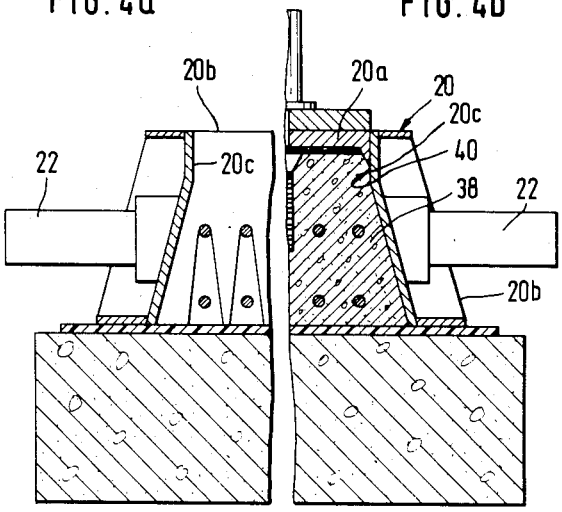
FIG. 4b
FIG. 5a
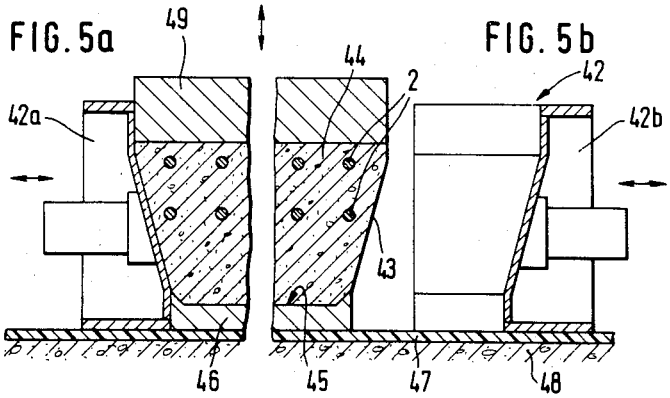
FIG. 5b

METHOD OF AND APPARATUS FOR THE MANUFACTURE OF PREFABRICATED PRESTRESSED CONCRETE MEMBERS

SUMMARY OF THE INVENTION

The present invention is directed to a method of and an apparatus for manufacturing prefabricated prestressed concrete members having immediate bond and, in particular, to the formation of prestressed concrete ties. The concrete members are formed on an elongated stressing bed with the concrete members being formed in one or a number of side-by-side rows. Prestressing members extend along the stressing bed and are anchored in stationary abutments. Forms for producing the concrete members are made up of several parts and the prefabricated members are constructed in several casting or working stations located one after the other along the stressing bed. Concrete is poured into and consolidated within one of the form parts and then another form part is placed over the filled part to complete the concrete member. Following the formation of a concrete member it is moved from one working station into another and the forms are removed from a previously constructed concrete member after the completion of the formation of the subsequently formed member.

It has been known to manufacture prestressed concrete ties on a long stressing bed with the ties located one behind the other and in several rows extending across the bed so that a large number of ties can be produced corresponding to the length of the stressing bed. Accordingly, there must be as many individual forms as there are ties to be constructed along the entire length of the stressing bed. In this method, the ties are produced inverted from the normal position with the form being shaped to afford the profile of the tie surface and the track support situated on that surface. Track attachment parts to be, encased in the concrete of the tie are attached to the forms. The concrete is poured into the forms and consolidated. When the concrete has set sufficiently, the fastening means for the concrete-encased track attachment parts are removed from the forms and then the forms are lifted off the ties. Next, the prestressing members are detached from the anchors on the stressing bed causing the stressing force to be transferred to the ties. After this, the prestressing members are severed between the individual ties and the ties are turned back into the normal position and the projecting ends of the prestressing members are removed.

In such a manufacturing operation there is the disadvantage that a large number of forms are required to produce the ties. Further, the consolidation of the concrete is not of sufficient intensity and, of necessity, the concrete consistency is such that it does not permit a quick stripping of the forms which is needed for a quick reuse of the forms. As a result, the quality of the concrete cannot be optimized as required because of the abrasion stress of the ballast bed, and the quantitative requirement of cement is relatively high. Moreover, this known method is not mechanized to the desired degree.

In the production of prefabricated prestressed concrete members with post-tensioning, especially in the formation of prestressed concrete ties, it has been known to choose the concrete consistency and to consolidate the concrete to such a high degree that the individual ties can be stripped immediately after the concrete is consolidated. This so-called instantaneous stripping process, however, cannot be applied to the formation of prefabricated prestressed concrete members on a long stressing bed because the vibration oscillations developed during consolidation of the concrete are propagated throughout the prestressed members and affect the previously constructed and stripped ties. In particular, there is the danger that the bond between the prestressing members and the concrete is lost.

To prevent the development of such vibration oscillations in the prestressed concrete members it has been known to provide devices along the stressing bed to fix the formed concrete members located immediately in front of and behind the member being fabricated in such a way that the vibration oscillations cannot be transmitted, note West German Patentschrift No. 26 14 036. In this production procedure, these fixing devices, which must be provided along the stressing bed, cause an additional expense. Furthermore, these devices prevent the forms in consecutive fabricating or working stations from being arranged closely together limiting the effective utilization of the length of the stressing bed and causing a loss of prestressing steel.

Therefore, it is the primary object of the present invention, to provide a method of and apparatus for prefabricated concrete members on a long stressing bed which includes the immediate stripping of the forms from the formed member. As a result, the supply of forms needed for the procedure is kept as small as possible and at the same time it is possible to provide optimum use of the length of the stressing bed and of the prestressing steel.

In accordance with the present invention, in addition to the forms required in each production step, a number of additional forms are needed which correspond to the number of prefabricated members being produced. While one or several prefabricated concrete members are being formed another group which were just produced are located in an adjacent working station. After the forms are filled and consolidated, the forms just previously produced are stripped and the working stations are rearranged to commence the next working cycle.

The basic feature of the present invention is that each of the prefabricated prestressed concrete members is not stripped immediately after the completion of the pouring and consolidation operation, rather, one additional single or group of forms is poured and consolidated before the previously poured member is stripped. Surprisingly, it has been found that when a highly consolidated prefabricated member is left in the form until the next one or series of members is poured and compacted, not only is it assured that the previously formed member is not damaged, but there is an intensification of the consolidation of the prestressing members with the surrounding concrete which is comparable to a reconsolidation of the concrete in the area of the prestressing members.

Further, the invention also includes an apparatus for carrying out this method including a framework spanning the stressing bed in the transverse direction in a portal-like manner and extending along the length direction of the stressing bed. The framework movable along the length of the bed and the framework length includes at least two adjacent working stations. A carriage is mounted on the framework and is movable on tracks in the longitudinal direction of the framework. The carriage includes a lifting device for carrying the top part of a form made up of at least two form parts so that the top part can be lifted and lowered and also moved in the horizontal direction of the stressing bed. The lifting device on the carriage has coupling members for attachment to the top form part and the bottom form part can be attached to the top part so that it can be moved with it along the framework.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 2 is a transverse sectional view taken along the line II—II in FIG. 1;

FIGS. 3*a* and 3*b* are transverse sectional views taken along the line III—III in FIG. 1 each representing a different operating procedure of the present invention;

FIGS. 4*a* and 4*b* are transverse sectional views, on an enlarged scale, taken along the line IV—IV in FIG. 1 with each representing a different operating procedure of the present invention; and FIGS. 5*a* and 5*b* are transverse sectional views similar to FIGS. 4*a* and 4*b* through a different form arrangement for producing a prestressed concrete tie in a position inverted relative to its normal position.

DETAILED DESCRIPTION OF THE INVENTION

Figure 1:
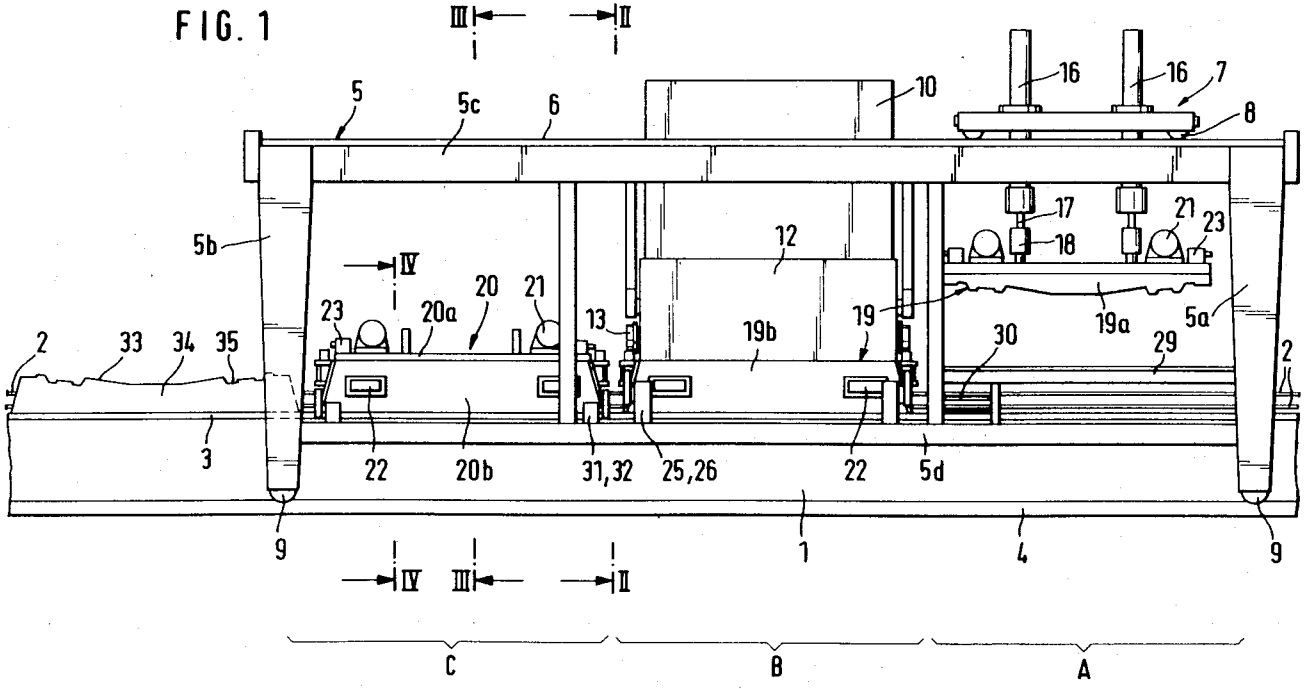
FIG. 1 is a side view of a portion of an apparatus embodying the present invention.

In FIG. 1 an apparatus is illustrated, in side view, for fabricating prestressed concrete ties on an elongated stressing bed 1. The long direction of the stressing bed is located in the plane of FIG. 1. Stressing bed 1 includes a long continuous concrete foundation and prestressing wires 2 extend over the bed and are stressed between rigid abutments, not shown, located at the ends of the stressing bed. An oscillationdampening covering 3 is placed over the surface of the stressing bed 1. Individual fabricating working stations are located along the stressing bed and one or several side-by-side ties can be produced in the working stations. In FIG. 1, three working stations A, B and C are shown one following the other with two ties being produced in each station, as can be seen in FIG. 2.

Along the opposite sides of and spaced outwardly from the stressing bed are tracks 4 on which a framework 5 travels. As can be seen in FIG. 1, the framework 5 has a portal-like frame 5*a*, 5*b* at each of its opposite ends spaced apart in the length direction of the stressing bed so that the frames extend transversely across and over the bed. Longitudinal supports 5*c* connect the upper ends of the frames 5*a*, 5*b* while the lower ends are interconnected by longitidinal supports 5*d*. Mounted on each of the longitudinal supports 5*c* is a track 6 extending in the long direction of the stressing bed and a carriage 7 with wheels 8 is movable along these tracks. Wheels 9 are located at the lower ends of the vertical posts of the frames 5*a*, 5*b* so that the entire framework 5 can be moved along the tracks 4 over the stressing bed 1.

A concrete storage hopper 10 is located along one side of the framework 5, note FIG. 2, and concrete can be supplied from hopper 10 into a lower charging hopper 12 when a closure flap 11 at the bottom of the hopper 10 is moved into the opened position. Charging hopper 12 is supported on wheels 13 and can be moved in the transverse direction of the stressing bed 1 when it is displaced by a linkage 14 over the tracks 15 extending horizontally across and over the stressing bed. The linkage is operated via a cylinder-piston-unit, not shown.

Several cylinder-piston-units 16 are supported on the carriage 7 and include upwardly and downwardly movable piston rods 17 on which coupling members 18 are attached. Coupling members 18 hold the top part 19*a* of a form 19 used for constructing the prestressed concrete tie. The form 19, in addition to the top part 19*a*, includes a bottom part 19*b*. In the operating condition shown in FIG. 1, the carriage 7 supporting the top parts 19*a*, is located in working station A. Previously, the corresponding bottom parts 19*b* have been placed on the stressing bed 1 in the working station B. This procedure is explained below. A previously poured form 20 in the assembled condition including top part 20*a* and bottom part 20*b* is situated in the working station C.

To consolidate the wet concrete mix used in forming the concrete ties, the top parts 19*a* and 20*a* of the form have external vibrators 21 and the lower parts 19*b* and 20*b* have external vibrators 22. Top parts 19*a* and 20*a* each have a catch 23 for connecting the top parts 19*a* and 20*a* to the corresponding bottom parts 19*b* and 20*b* of the forms. The forms 19 and 20 are of the same construction.

Bottom parts 19*b* and 20*b* are connected to one another by transverse supports 24, note FIGS. 2 and 3. Clamping levers 25 are mounted on the framework 5 and are operated by means of cylinder-piston-units 26 for pressing the bottom parts 19*b* of the form 19 against the pressing bed 1. Rubber-metal elements 27 are positioned between the levers 25 and the supports 24 and are provided so that it is possible to vary the contact pressure of the bottom parts 19*b* against the oscillation-dampening covering 3 on the stressing bed 1. Accordingly, it is possible to vary the oscillation behavior of the bottom parts 19*b* of the forms so that they enter into resonance with the vibration oscillations produced and the energy supplied for the consolidation of the concrete can be utilized in the most advantageous way.

While the ties are being poured in a working station, the framework 5 is locked in position relative to the tracks 4 by track clamps 28.

In the working station A, the framework 5 includes a working platform 29 for servicing the top parts 19*a* of the forms, for example for cleaning and installing the track attachment part in the form. Working station A also includes sheet metal guide 30 for guiding the prestressing wires 2. In the working station C levers 31 are located on the framework 5 for lifting the lower parts 20*b* of the form. The levers 31 are similar to the levers 25 and are operated by cylinder-piston-units 32.

In carrying out the method of producing the prestressed concrete ties in accordance with the present invention the method proceeds as follows:

In the operating procedure represented in FIG. 1, the bottom parts 19*b* of the form have been placed on the oscillation-dampening covering 3 of the stressing bed 1 and are pressed against the covering by the clamping levers 25, note FIG. 2.

The bottom parts 19*b* of the form are filled with concrete from the charging hopper 12 which is movable over and across the stressing bed 1. The charging hopper 12 is open at the top and the bottom and is moved by a linkage 14 over the bottom parts 19*b*. As the charging hopper 12 rolls over the tracks 15, the concrete is pushed over a sheet metal guide 15*a*. By moving the charging hopper 12 back and forth over the bottom parts 19*b*, the form parts are filled. When the filling operation is completed, the charging hopper 12 returns to its initial position spaced laterally from the stressing bed and is refilled from the storage hopper 10. By switching on the vibrators 22 on the bottom parts 19 for a short period, the concrete poured into them is preconsolidated.

After such preconsolidation, the bottom parts 19*b* are completely filled and the charging hopper 12 is again returned to its starting position and the main consolidation step is carried out. The preconsolidation of the concrete makes it possible to vary the actual amount of concrete filled into the form.

At the same time in the working station A, the necessary preparation of the top parts 19*a* of the form is carried out from the working platform 29. Such form preparations include cleaning the top parts, spraying them with form oil, and placing the track fastening parts, which are to be encased in the concrete ties, in the top parts.

For the main consolidation operation, carriage 7 is driven along the framework 5 carrying the top parts 19*a* held by means of the coupling devices 18, into the working station B aligned over the bottom parts 19*b* of the form which have been filled with concrete. Top parts 19*a* are lowered by the cylinder-piston-units 16 and pressed against the concrete in the bottom parts 19*b*. With the parts assembled together, the external vibrators 22 on the lower parts and the external vibrators 21 on the top parts are placed in operation.

By pressing the top parts 19*a* downwardly against the concrete in the bottom parts 19*b*, the surfaces 33 of the ties are formed with the track supports 35 located thereon. At this time, the track attachment parts are vibrated into the concrete forming the ties.

When the desired consolidation of the concrete within the assembled form 19 has been achieved, the vibrators 21, 22 are turned off. Next, the top parts 19*a* are released from the coupling devices 18 on the carriage 7. The carriage 7 is driven to the next working station C and the coupling devices 18 are attached to the top parts 20*a* of the forms 20 which contain a tie that had just previously been poured. By operating the lever 31, bottom parts 20*b* are lifted slightly upwardly from the oscillation-dampening covering 3 until they are clear of the surfaces of the freshly poured concrete members, note FIG. 3*a*. At this time, the catches 23 connect the bottom parts 20*b* to to the top parts 20*a* of the form 20. The fastening means for the concrete-encased track attachment parts are detached and the entire form 20 is lifted upwardly, note FIG. 3*b*. During the pouring procedure, the form 20 enclosing the previously poured concrete tie is not stripped until the pouring and consolidation of the concrete in the form 19 is completed. With the carriage 7 supporting the form 20, the framework 5 is moved to the right, as viewed in FIG. 1, for a length of one working station, so that the middle portion of the framework 5 containing the working station B is positioned over free prestressing wires 2. At this point, carriage 7 supporting the form 20 is moved from the working station C into the adjacent working station B and the form 20 is lowered onto the oscillation-dampening covering 3 of the stressing bed 1. By operating the clamping lever 25, the bottom parts 20*b* of the form 20 are pressed against the covering 3 and held in this position. Actually, the complete form 20 is positioned on the stressing bed, next, the catch 23 securing the top parts 20*a* to the bottom parts 20*b* is released. Top parts 20*a* held by the coupling devices 18 on the carriage 7 are then moved into the working station A for cleaning and preparation in the manner described above with regard to the top parts 19*a* of the form 19 which was previously poured.

The procedure for forming the ties is repeated in the same manner until the stressing bed is filled along its entire length with freshly formed ties 34. In accordance with the procedure of the present invention, it is assured that a freshly formed tie remains enclosed within its form until the next adjacent tie is constructed and it is only at that time that the previously formed tie is stripped.

In FIGS. 4*a* and 4*b*, the form 20 is represented on a larger scale, in FIG. 4*a* the form is shown in the empty condition without the top part 20*a* positioned on the bottom part 20*b*. In FIG. 4*b* the form 20 has been completely assembled and is filled with concrete 38.

In FIG. 4*a* the empty bottom part 20*b* is shown with the attached external vibrators 22. Spaced upwardly from the bottom part 20*b* is the corresponding top part 20*a*. Secured to the top part 20*a* is the fastening means 36 for the track attachment part 37 which is to be encased in the concrete forming the tie. The track attachment part 37 can be a plastic corrugated dowel for a tie screw with which elastic and gauge-forming track attachment means can be attached on the prestressed concrete tie.

In FIG. 4*b* a section is shown through the assembled form 20 filled with concrete 38, the form is made up of the top part 20*a* fitted downwardly onto the upper end of the bottom part 20*b*. At the upper end of the bottom part 20*b*, a vertical wall 20*c* extends along and in contact with a corresponding vertical wall 20*d* of the top part 20*a*. An inwardly facing bevel 39 is formed on the top part 20*a*. The concrete mass filled into the bottom part 20*b* is consolidated, accordingly, it is possible that differences in the total height of the tie may occur within acceptable tolerances. An exact transition from the top surface of the tie to its side surfaces is achieved so that each tie, in its upper region, has a vertical surface 40 of variable height formed by the cooperating vertical walls 20*c*, 20*d* on the bottom part 20*b* and top part 20*a* of the form 20.

Since air rises during the consolidation of the concrete in the bottom part 20*b* of the form, to assure that the surface 33 of the tie 34 is not very porous and unusable, the air must be able to escape or to be absorbed when the top parts 20*a* of the forms are placed on the bottom parts 20*b*. By inserting a covering 41 as the lower surface of the top part 20*a*, it is possible to absorb water and air with the covering being held by means of a vacuum or adhesion to the bottom side of the top parts 20*a*. The covering can be formed of paper or a textile material which is capable of affording the desired effect.

In the procedure described above and illustrated in FIGS. 1–4, the prestressed concrete ties are produced in the normal use position by utilizing the method and/or apparatus of the present invention, it is also possible to construct such ties in the inverted position. Similarly, other prefabricated prestressed concrete parts suitable for continuous production along a stressing bed can be formed. A form suitable for producing ties in the inverted position is represented in FIG. 5. In FIG. 5*a*, a tie 44 is shown in section before the bottom part 42*a* is stripped while in FIG. 5*b* the tie 44 is shown with the bottom part 42*b* stripped away from the tie.

The form 42 displayed in FIG. 5 is made up of the two bottom parts 42*a*, 42*b* which only serve to form the side walls 43 of the tie 44. The top surface 45 of the tie, the bottom surface as viewed in the drawing, is shaped by means of a profiled base 46 which rests on the oscillation-dampening covering 47 which covers the stressing bed 48. In place of the top parts described in the other forms, in form 42 a plate 49 acts as a surcharge on the top of the concrete. In the condition shown in FIG. 5*b*, the bottom part 42*b* has been stripped from the tie 44.

While specific embodiments of the invention have been shown and described in detail to illustrate the application of the inventive principles, it will be understood that the invention may be embodied otherwise without departing from such principles.

We claim:

1. A method of manufacturing individual prefabricated prestressed concrete members each containing prestressing members, such as prestressed concrete ties, where the concrete members have an immediate direct bond with the prestressing member, including using forms for shaping the concrete members with each form arranged to hold an individual concrete member and with the form made up of at least a first form part and a second form part, positioning the forms on an elongated stressing bed having a first end and a second end and a length sufficient between the first and second ends to receive a multiple number of the concrete members arranged in a row extending in the elongated direction of the stressing bed, and arranging the forms in at least one row commencing adjacent the first end of the stressing bed, placing continuous prestressing members over and extending along the elongated direction of the stressing bed for the at least one row and stressing such members between rigid abutments located at the first and second ends of the stressing bed so that the prestressing members afford prestressing of each of the individual concrete members to be formed in the at least one row, wherein the improvement comprises maintaining the stress on the prestressing members while constructing the concrete members one after another along the elongated direction of the bed so that the prestressing members extend continuously through and between the formed concrete members, establishing a group made up of a first location, a second location and a third location arranged in series adjacent to and following one another in the elongated direction on the stressing bed so that the group of first, second and third locations can be moved as a unit along the stressing bed, positioning the first location closer to the first end of the stressing bed and followed in the elongated direction thereof by the second location and then the third location with the third location located closer to the second end of the stressing bed, providing a poured concrete member within the assembled form parts in the first location with the prestressing members extending through the poured concrete member, placing a first form part on the stressing bed in the second location so that the stressed prestressing members extend freely and unsupported in the elongated direction of the prestressing bed through the first form part and between the first form part and the third location, pouring concrete into the first form part in the second location for at least partly filling the first form part and vibrating the first form part for preconsolidating the concrete poured therein, after the preconsolidating step completely filling the concrete into the first form part into bonding contact with the prestressing members and then moving a second form part from the third location and placing it on the first form part in the second location into which the concrete has been poured and is completely filled and attaching the second form part to the first form part, vibrating the attached first and second form parts and effecting the main consolidation of the concrete member, following completion of the main consolidation of the concrete member in the second location stripping the first and second form parts from the poured concrete member located in the first location on the stressing bed, moving the group of locations downstream in the elongated direction of the stressing bed toward the second end thereof so that the first location is positioned in the location vacated by the second location and second location is in the position vacated by the third location, placing the first form part stripped in the first location in the relocated second location and repeating the working cycle until the concrete members extend one after the other along the stressing bed between the rigid abutments for the prestressing members.

2. A method, as set forth in claim 1, including the steps of positioning the second form part of the stripped form in the relocated third location, and cleaning and preparing the second form part for placement on the first form part in the relocated second location.

3. A method, as set forth in claim 2, including in the step of preparing the second form part in the third location, the steps of securing track attachment parts to the second form part in the third location and, after moving and placing the second form part on the first form part, in the second location, pressing the track attachment parts into the concrete poured into the first form part.

4. A method, as set forth in claim 1, including the steps of using the first form part for forming the sides of the concrete member with the first form part being open at the upper end thereof for pouring concrete into the first form part, placing the second form part into the open upper end of the first form part and pressing the second form part downwardly into the concrete poured into the first form part.

5. A method, as set forth in claim 1, wherein in the normal use position the concrete member has an upwardly facing surface and a downwardly facing surface and including the steps of forming and pouring the concrete member in the inverted position with the upwardly facing surface thereof directed downwardly.

* * * * *